United States Patent [19]

Gramlow

[11] Patent Number: 5,001,993

[45] Date of Patent: Mar. 26, 1991

[54] STOVE FOR BURNING BIO-MASS PELLETS AND GRAIN

[76] Inventor: David E. Gramlow, E. 7827 Bigelow Gulch Rd., Spokane, Wash. 99207-9698

[21] Appl. No.: 460,534

[22] Filed: Jan. 3, 1990

[51] Int. Cl.[5] ..... F23B 7/00

[52] U.S. Cl. ..... 110/233; 110/110; 110/314; 126/58; 126/200

[58] Field of Search ..... 110/110, 233, 314; 126/58, 65, 66, 200

[56] References Cited

U.S. PATENT DOCUMENTS

| | | | |
|---|---|---|---|
| 4,385,566 | 5/1983 | Harris . | |
| 4,493,270 | 1/1985 | Gamroth . | |
| 4,515,088 | 5/1985 | Orjala . | |
| 4,517,903 | 5/1985 | Richmond et al. . | |
| 4,520,740 | 6/1985 | Carpenter . | |
| 4,565,184 | 1/1986 | Collins et al. . | |
| 4,619,209 | 10/1986 | Traeger et al. . | |
| 4,669,396 | 6/1987 | Resh . | |
| 4,782,765 | 11/1988 | Miller et al. . | |
| 4,787,322 | 11/1988 | Whitfield . | |
| 4,856,438 | 8/1989 | Peugh | 110/110 X |

FOREIGN PATENT DOCUMENTS

| | | |
|---|---|---|
| WO83/01672 | 5/1983 | Int'l Pat. Institute . |
| 16208 | 1/1985 | Japan . |

*Primary Examiner*—Edward G. Favors

*Attorney, Agent, or Firm*—Keith S. Bergman

[57] ABSTRACT

A free-standing, thermostatically controlled stove provides positive draft combustion of bio-mass pellets or cereal grains. Particulate bio-fuel is gravity fed from a hopper into a first slower moving auger conveyor which feeds a second faster moving sugar conveyor that communicates with the lower side portion of a combustion container carried in a combustion chamber. A pilot burn is continuously maintained in the combustion container end of the second conveyor. The combustion container has vertically spaced air plena that provide combustion air and input holes to allow recirculation of combustion chamber gases for secondary combustion. The fire chamber exhausts combustion gases through a negative pressure, downdraft type exhausts with a selectively openable valved orifice to allow updraft operation at critical burning periods. A programmable micro-processor regulates operating parameters to provide distinguishable pre-programmed combustion cycles for maximum efficiency with only two operator controls for off/on and thermostatically controlled operation.

11 Claims, 3 Drawing Sheets

STOVE FOR BURNING BIO-MASS PELLETS AND GRAIN

BACKGROUND OF INVENTION

RELATED APPLICATIONS

There are no applications related hereto heretofore filed in this or any foreign country.

FIELD OF INVENTION

My invention relates generally to a positive draft stove for burning particulate bio-mass fuel fed through a double conveyor system that maintains continuous combustion, with selective updraft or downdraft operation and enhanced traditional amenities for clean combustion.

BACKGROUND AND DESCRIPTION OF PRIOR ART

Bio-mass pellets of various types and even cereal grains, especially such as corn and wheat, have become common and popular fuel sources for stoves in the recent past. Many and various stoves and furnaces of a specialized type required to burn such materials have become known. The instant invention adds a new and novel member to this class of combustion device.

Bio-mass pellets are formed of various agricultural and arboreal waste materials by compressing the finely particulated material into agglomerated masses, with or without binders. Such pellets commonly are formed in a cylindrical configuration of approximately 0.025 to 0.32 inch diameter and random lengths averaging about 0.7 inch, largely by historicity and the nature of the forming process. These materials, and even various unmodified cereal grains, will combust to provide a fuel source for stoves and furnaces, but to provide reasonable efficiency in such combustion its parameters must be fairly well and finely regulated, especially by providing forced drafts; preventing backfire; providing long dwell time of combustion gases in a fire chamber, preferably with secondary combustion; preventing backfires; and maintaining a pilot fire for continuous operation.

Such burning processes have been further complicated in the recent past by marked increase in governmental regulation in an effort to lessen environmental pollution. Responsive to these demands, many and various stoves and combustion processes have evolved. Through the course of this evolutionary development, both apparatus and processes have become increasingly sophisticated. Nonetheless, various problems persist in known combustIon devIces which tend to be adapted to solve one particular problem often at the expense of other problems, but which in general do not simultaneously resolve the broad spectrum of problems involved to present a single combustion device of high efficiency, low cost and simple operation that yet meets the required regulatory standards. The instant invention seeks so to do.

The maintenance of combustion in bio fuel stoves has been solved in two general ways, firstly, by maintaining a continuous pilot fire in a combustion area and secondly, by using ignition devices of various sorts to reinstitute combustion. The maintenance of a continuous pilot burn generally has expended substantial amounts of fuel and oftentimes creates excessive heat that is not desired and cannot be easily dissipated or wasted. Ignition devices that have become known have not proven to be particularly efficient or even consistently operative, by reason of the nature of the particular fuel involved, and are not presently very widely used. The instant invention maintains a pilot fire in the inner end of the tube of an auger-type conveyor that moves fuel into a combustion container at its lower lateral part. This function is accomplished by containing the bio-fuel in a relatively small, reasonably confined area where threshold combustion temperatures may be readily maintained and combustion air provided. In general, this type of pilot fire has not been allowed by prior bio-mass stoves having auger feed systems because such systems commonly fed from either the bottom or the top of a combustion pot rather than its lower lateral portion, and secondly, because the particular feed systems involved would cause or allow backfire through an auger-type feed system to cause fuel combustion exteriorly of a stove's combustion chamber with resultant problems and damage. Such backfires are prevented in the instant auger system by reason of a double conveyor fuel feeding system which maintains the combustion container feeding auger in a less than half full condition so that fuel in adjacent auger flights is not in contact, but rather physically separated from fuel in either adjacent flight, to prevent the propagation of combustion between the separated fuel masses.

The lateral feed of fuel to a combustion container, immediately upwardly adjacent its lower portion, additionally provides improved combustion in my invention. Commonly in bio-mass stoves of the present day, fuel is fed vertically, either from beneath or above a combustion chamber, and this type of feed has rather essentially limited the nature of the combustion process since that process is gravity oriented. Normally combustion in a particulated fuel mass tends to proceed in an upward direction and when fuel is input vertically into the combusting mass vertically, this tends to render the combustion less efficient because if the fuel is placed above a combusting mass, it tends to prevent proper combustion of the mass therebeneath and if it is placed beneath the combusting mass, it tends to smolder and combust in an improper fashion because of deficiencies of both heat and air. My invention in contradistinction feeds fuel substantially into the burning mass from a lateral position so that the input fuel does not cover and is not covered by the burning mass. Additionally, the particular arrangement of input conveyor and combustion container allows the combustion container end of the input auger structure to carry a mechanical agitator which rotates in the bottom portion of a combustion container to stir the burning fuel mass therein to create homogeneity of the combusting mass and eliminate problems associated with the gravity oriented nature of the burning process. Such agitation of the burning fuel mass also provides secondary benefits in aiding the removal of fly ash from the combustion chamber and in preventing the formation of clinkers, especially as caused by earth derived contaminates in the bio-fuel.

The particular structure of my combustion container further aids the efficiency of its combustion process. The combustion container has some vertical extent and provides combustion air input in three vertically spaced, annular zones located at the bottom of the pot, in its medial portion, and at its top. This provides combustion air at the level of the particulate fuel and at two zones spacedly thereabove to aid secondary combustion at different heights. Additionally, a plurality of orifices communicate from the fire chamber through the combustion container at a level between the medial and upper air input zones to input gases from the fire chamber back into the combustion container and recirculate them through the upper combustion zone of the combustion container to further enhance their combustion. This recirculatory action is further encouraged by the general configuration of the fire chamber and its downdraft operation.

It heretofore has been found that the completeness of the combustion reaction in bio-fuel stoves is substantially directly proportional to the dwell time of combustion gases in the combustion chamber, and this action is enhanced by circulation of the gases back through the primary combustion zones. This recirculatory action of combustion gases is aided by a downdraft-type operation wherein the exhaust is removed from the fire chamber at a lower position near its floor rather than at the top portion. Downdraft exhaust has not heretofore been particularly popular in bio-mass stoves, however, as at critical combustion periods when a fire is starting or increasing its intensity, the downdraft system is not particularly efficient, if it is operative at all, and it may cause smoking or backfire. Similarly at times of combustion shut-down, the downdraft exhaust system tends to have somewhat the same reaction. I resolve these problems by providing an optional updraft exhaust system, communicating with the output of the downdraft system and controlled by a micro-processor operated damper, to open for selective operation at critical burn periods to provide an updraft exhaust during those periods. The operation is further enhanced by a negative pressure-type exhaust system wherein a fan is carried in the output channel of the exhaust channel to lower air pressure in that area to cause a positive flow of input combustion gases at atmospheric pressure rather than at a pressure above atmospheric pressure as in forced air combustion systems.

The instant invention in providing these features still allows the use of other amenities heretofore known and commonly used in present day bio-mass combustion devices.

My invention lies not in any one of these features per se, but rather in the synergistic combination of all of the structures of my invention that give rise to the functions necessarily flowing therefrom and is distinguished from the prior art in so doing, as herein specified and claimed.

SUMMARY OF INVENTION

My invention generally provides a free-standing stove to burn particulate bio-fuel in an automated manner responsive to thermostatic control.

A casement peripherally defines a combustion chamber with a flat cooking top portion, forward ash removal and access doors and a rearward hopper structure for storage of bio-mass fuel. A combustion container supported in the lower medial portion of the fire chamber defines vertically spaced, annularly arrayed sets of lower, medial, and upper combustion air orifices. Each set of combustion air orifices is serviced by a plenum on the exterior of the combustion container to input combustion air from the ambient atmosphere. The hopper structure feeds bio-ass fuel downwardly into a slower auger type conveyor that feeds the fuel into a second faster auger-type conveyor thai inputs the fuel into a lower lateral portion of the combustion container. The inner end of the second conveyor auger carries an agitator that rotates in the particulate fuel in the combustion pot. The inner end portion of the second conveyor tube defines an area wherein fuel maintains a continuous pilot burn.

A downdraft exhaust system communicates from a lower lateral portion of the fire chamber through a negative pressure fan for exhaustion of combustion gases. A secondary updraft channel, interconnected with the downdraft channel, communicates from an upper portion of the fire chamber through a selectively openable valve to provide updraft exhaust at critical combustion periods. The downdraft exhaust gases pass through a plenum having heat exchange tubes to aid heat transfer from the stove. An associated microprocessor controls functioning of the stove through predetermined cycles, responsive to thermostatic input, to provide automatic operation from pilot burn rates of 0.1 pound of fuel per hour to full burn thermal outputs of approximately 42,500 BTU.

In creating such a device, it is:

A principal object of my invention to provide a free-standing stove that burns particulate bio-mass material with substantial efficiency and in a semi-automatic fashion.

A further object of my invention is to provide such a device that feeds fuel by gravity from an elevate hopper into a first slower moving conveyor that feeds the fuel to a second faster moving auger conveyor so that the flights of the second conveyor never fill more than half full of fuel to prevent burn back and allow a pilot fire to be maintained in the output end of the second conveyor tube.

A further object of my invention is to provide such a device with a fire chamber carrying in its lower medial portion a combustion container having three annularly arrayed, vertically spaced combustion air input zones in its lower, medial, and upper portions with orifices defined in the combustion container between the upper and medial air input zones to receive gases from the fire chamber for recirculation in the upper portion of the combustion container.

A further object of my invention is to provide such a stove wherein the second auger shaft extends spacedly above the bottom of the combustion container and carries agitator structure that rotates to admix material in the lower portion of the combustion container to maintain uniform combustion, remove fly ash and prevent clinker formation.

A still further object of my invention is to provide such a stove that has downdraft exhaust during full burn operation with exhaust gases passing through a plenum carrying a heat exchanger and exiting through a negative draft exhaust channel, but yet provides an auxiliary valve controlled updraft channel that allows selective updraft exhaust operation at critical burn periods.

A still further object of my invention is to provide such a stove that is controlled by a micro-processor for automatic continuous operation in discrete predetermined cycles responsive to thermostatic control means.

A still further object of my invention is to provide such a stove that is of new and novel design, of rugged and durable nature, of simple and economic manufacture and one that is otherwise well suited to the uses and purposes for which it is intended.

Other and further objects of my invention will appear from the following specification and accompanying drawings which form a part hereof. In carrying out the objects of my invention, however, it is to be understood that its features are susceptible to change in design and structural arrangement with only one preferred and practical embodiment being illustrated in the accompanying drawings, as required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figure 1:
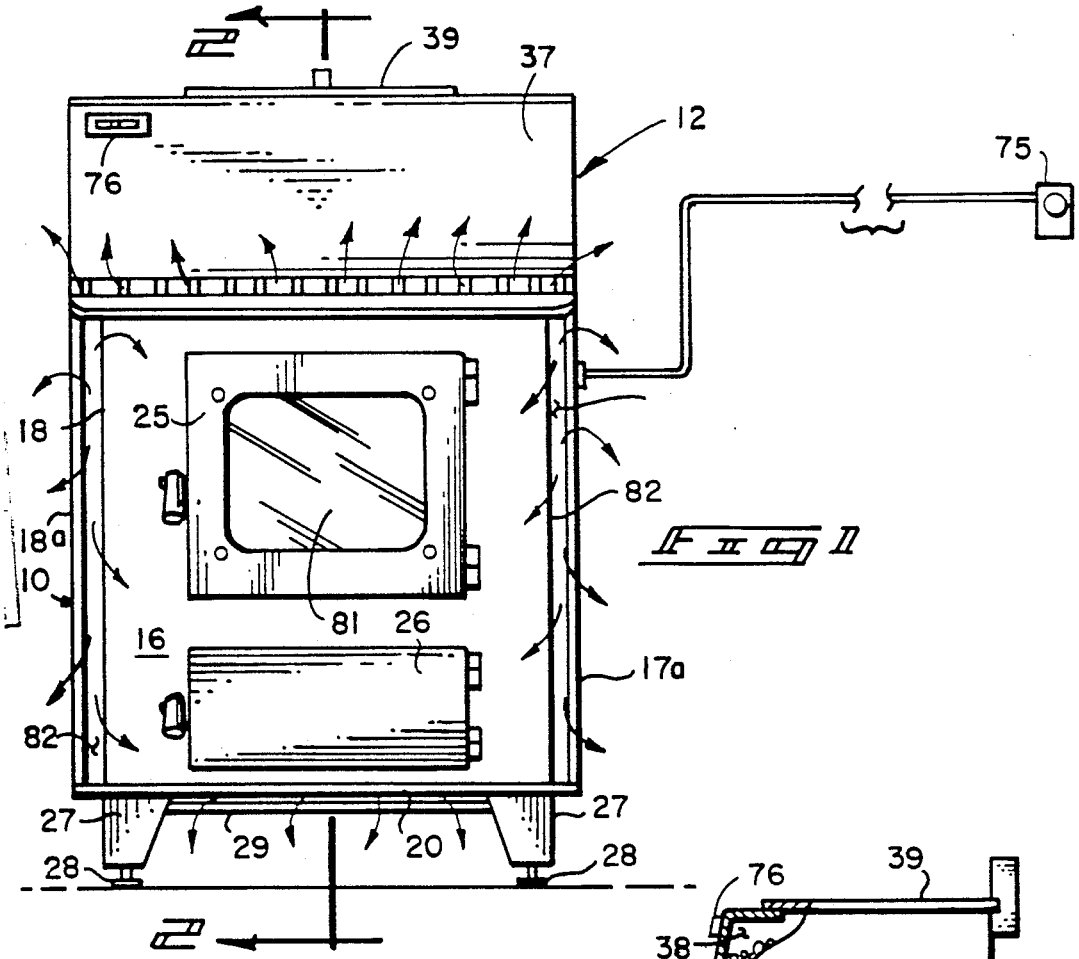
FIG. 1 is an orthographic front view of my stove showing various of its parts, their configuration and relationship.
Figure 2:
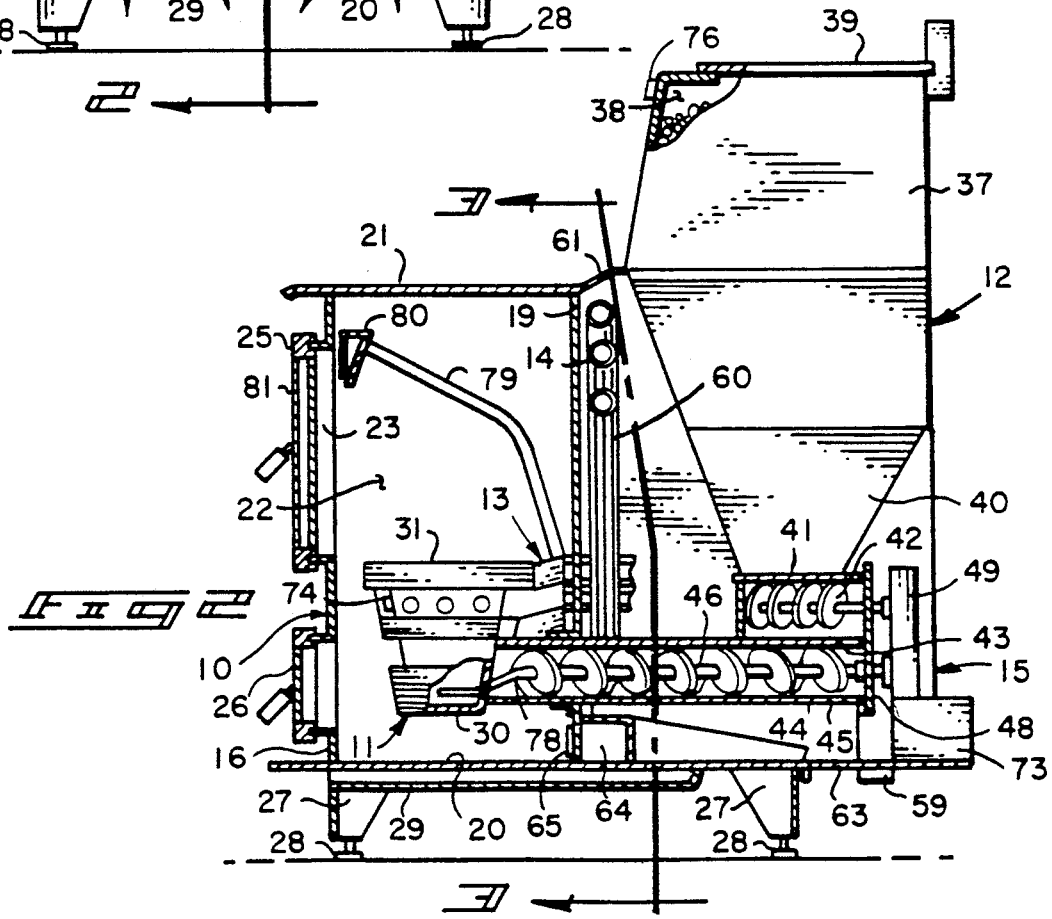
FIG. 2 is a vertical cross-sectional view through the stove of FIG. 1, taken on the line 2—2 thereon in the direction indicated by the arrows, to show various internal structure.
Figure 3:
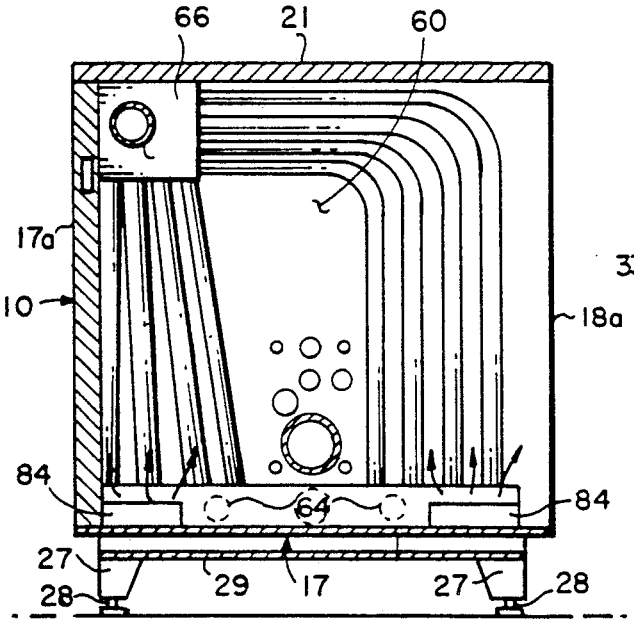
FIG. 3 is a broken vertical section through the heat exchange plenum between the stove casement and hopper, taken on the line 3—3 of FIG. 2 in the direction indicated by the arrows.

My invention generally provides casement 10 defining a fire chamber carrying combustion container 11, which receives fuel from fuel system 12 and combustion air from combustion air system 13, and exhausts combustion products through exhaust system 14, all as regulated by control system 15.

Casement 10 provides front 16, similar sides 17, 18, back 19, bottom 20 and top 21, all structurally interconnected at adjoining edges to peripherally define enclosed fire chamber 22 in traditional stove fashion. Front 16 defines upper access door orifice 23 and lower ash door orifice 25, each hingeably carrying sealably fitting latchable access door 25 and ash door 26, respectively. Bottom 20 is supported spacedly above a surface supporting the stove by plural legs 27 carrying threadedly engaged depending leveling screws 28 in their lower portion. Commonly, auxiliary bottom element 29 will be provided spacedly beneath bottom 20 to thermally insulate the area beneath the stove from excessive heat transfer from the stove bottom. Rearward portion 20*a* of the bottom element extends rearwardly beyond back 19 to provide support for the adjacent fuel feed system and control mechanism. Top 21 is a flat planar element of substantial heat conductivity to provide a surface that may be used for cooking if desired. Back 19 defines appropriate orifices required for passage of elements of the fuel feed, combustion air, and exhaust systems.

The casement elements are formed of rigid material of appropriate thermal resistance, generally sheet steel. A window for optical viewing of the combustion process is defined in access door 25, and is formed from thermally resistant transparent material, commonly high temperature glass. Any or all of the casement elements may be insulated, especially on their outer surfaces, to lessen transfer of heat therefrom, should this be desired. In general, however, with most free-standing stoves, it is desired that heat pass freely from the casement surface and if so, no insulation is provided.

Combustion container 11 provides open topped fire pot 30 tapering from a larger square upper orifice 31 downwardly and inwardly to cylindrical bottom 32 having a forward-rearwardly extending axis, all to define combustion area 33. Fire pot 30 is supported in the lower medial portion of fire chamber 22, spacedly above casement bottom 20, by the input auger tube 44 and combustion air input channels 54, 55 which in turn are supported by casement back 19. The space between the bottom of fire pot 30 and bottom element 20 of the casement provides an area for collection of ash and insulates the casement bottom somewhat from heat generated in the combustion container.

Fire pot 30 defines a plurality of combustion air input holes 34 defined in three vertically spaced, annular zones located at the bottom portion, in the medial portion, and at the top portion of the fire pot. The number and size of these air input holes is not critical, but should be related to combustion air input parameters and exhaust pressures to input sufficient air into the burning chamber to accomplish proper combustion of fuel therein. Between the zones of upper and medial combustion air input holes, there is defined a plurality of larger, spaced combustion gas holes 35 that allow partially burned gases in the combustion chamber to reenter therethrough into the upper portion of fire pot 30 for additional secondary combustion. The fire pot 30 defines fuel input orifice 36 in its lower rearward portion to receive the inner end of second fuel input conveyor tube 44.

The dimensioning of the fire pot 30 is not critical, but in general for proper combustion and circulation of combustion gases the fire chamber above the top of the fire pot should be approximately at least the height of the fire pot, and the volume of the fire pot should be approximately one-sixth the volume of the combustion chamber for efficient operation. Fire pot 30 must be formed of some reasonably rigid, thermally durable material. I have found cast stainless steel to be ideal for the purpose, though other materials such as ordinary steel, cast iron and various ceramics may serve the purpose of my device.

Fuel feed system 12 provides vertically extending hopper 37 peripherally defining fuel storage chamber 38 that is accessed through hinged top 39 and feeds solid particulated fuel therein by gravity to lower output spout 40. Hopper 37 is supported spacedly rearwardly of back 19 of the casement to define a heat exchange plenum for the exhaust system between the hopper and the casement.

Side panels 17*a*, 18*a* are carried spacedly outwardly of casement sides 17, 18 respectively to define channels on the sides of the heat exchange plenum having openings 82 to exchange heated air exchange from the heat exchange plenum.

Figure 7:
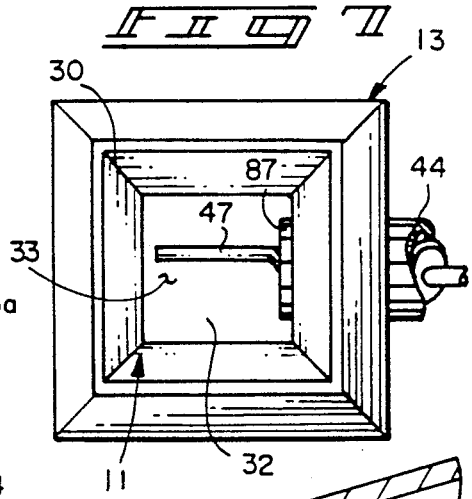
FIG. 7 is a top or plan view of the fire pot of FIG. 6 to show its configuration and interconnection with the auger fuel feed structure.
Figure 4:
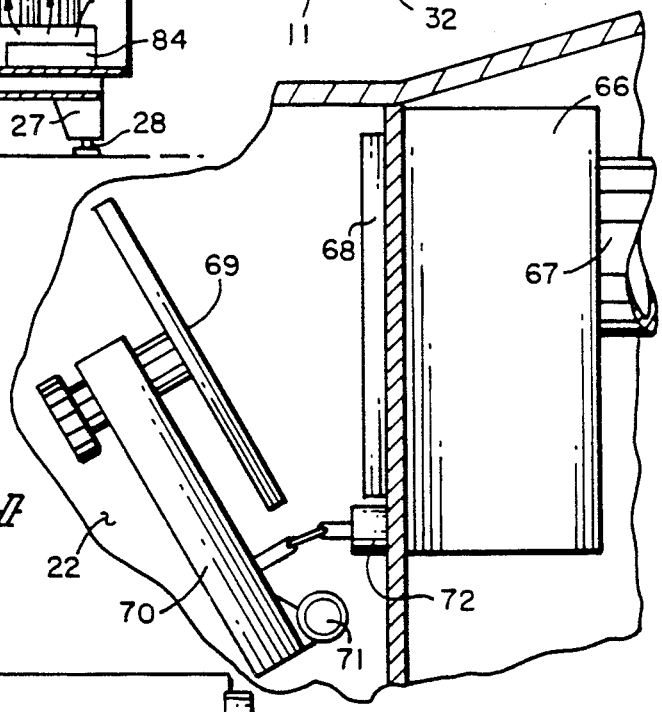
FIG. 4 is an enlarged orthographic view of the updraft exhaust port and its associated valving structure.
Figure 5:
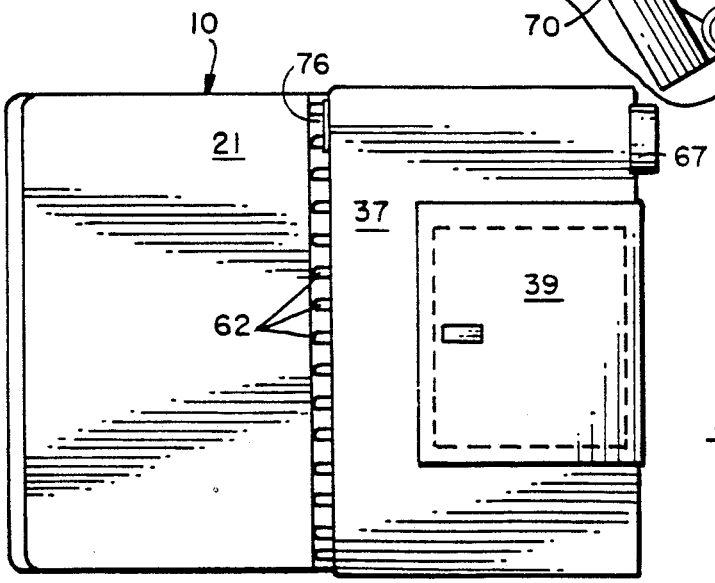
FIG. 5 is an orthographic top view of the stove of FIG. 1.
Figures 6, 8, 9:
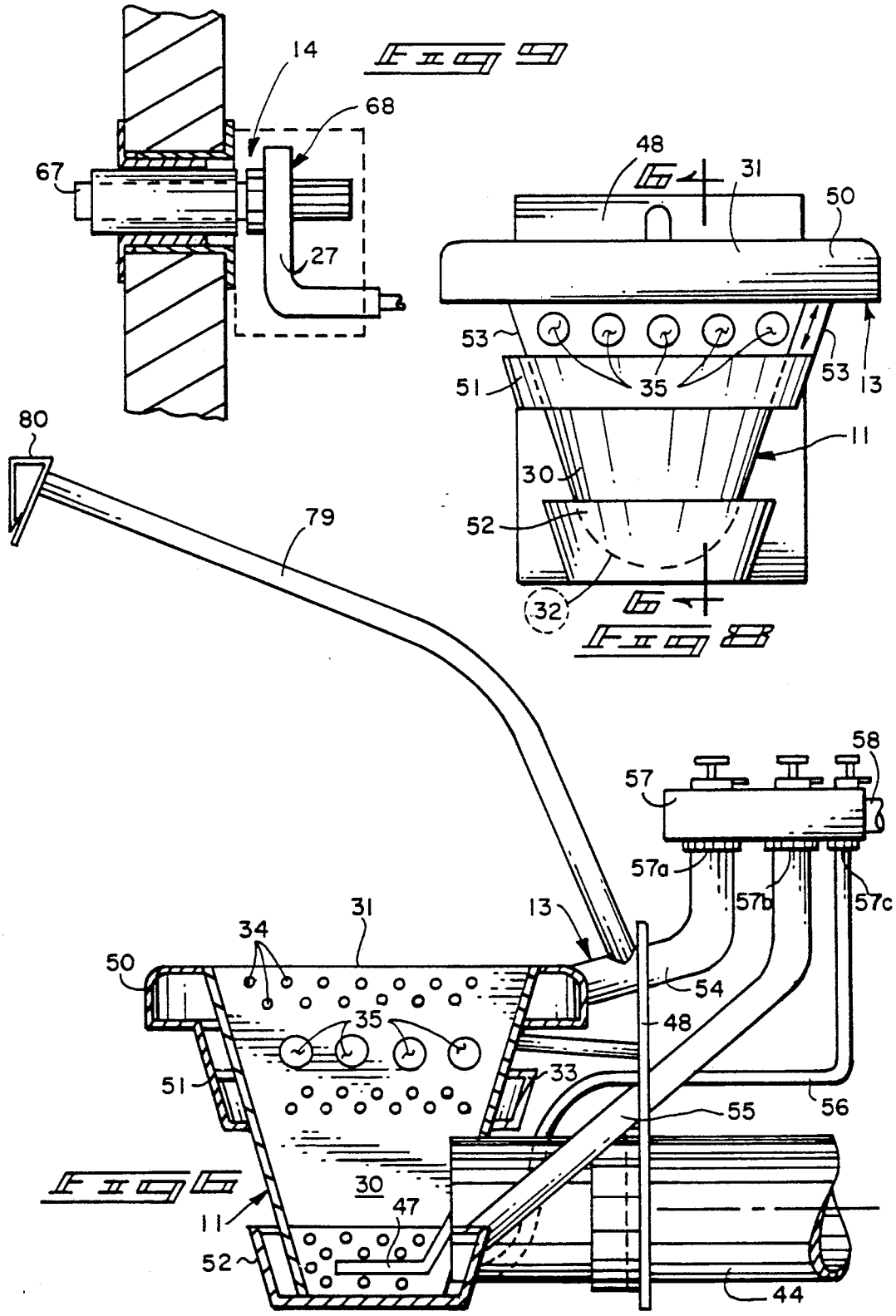
FIG. 6 is a somewhat enlarged vertical cross-sectional view of the combustion container and associated structure taken on the line 6—6 on FIG. 8 in the direction indicated by the arrows.
FIG. 8 is an orthographic front view of the combustion container.
FIG. 9 is a partial cross-sectional view through the wall of a structure housing my stove to show the exhaust output structure.

Output spout 40 of the hopper passes particulate fuel vertically downward by gravity into a shorter first fuel conveyor having conveyor tube 41 internally carry rotatable auger 42 to move fuel rearwardly from the hopper output spout. This first conveyor tube moves particulate fuel rearwardly to exit orifice 43 defined in the lower rearward part of tube 41, from whence it passes by gravity to second faster conveyor therebeneath. This second conveyor provides auger tube 44 rotatably carrying spiral auger 45 formed about medial shaft 46. Inner end portion of second auger tube 44 structurally communicates with fuel input orifice 36 of fire pot 30 and extends slightly within the fire pot. The inner end of auger 45 terminates at the inner end of tube 44 to provide an area in the end portion of the second auger tube where a pilot fire may be maintained. Medial shaft 46 of the second auger mounts an arm-like agitator 47 to stir and mix materials in the bottom of the fire pot. The agitator provides angulated portion 17*a* fastened to the inner end of auger shaft 46 with body portion 17*b* extending a spaced distance parallel to the auger shaft for eccentric rotation in the cylindrical bottom portion of the fire pot to disturb and admix material therein, as shown in FIGS. 7 and 9. The inner end portion of auger shaft 46 is free floating, as illustrated in the drawings, but if desired, it could extend into a bearing structure (not shown) carried by the forward portion of fire pot 30.

Both conveyor augers are supported for rotation in appropriate bearings carried by rearward conveyor support plate 48 which is supported by the auger tubes themselves. The axles mounting both conveyor augers extend through and rearwardly of support plate 48 to operative interconnection with conveyor drive mechanism 49 which operates the first conveyor at a rotary speed greater, generally by a factor of two, than that of the first conveyor. Each of the conveyors are of similar size and configuration so that this difference in operating speed does not allow the second conveyor to fill with material that is delivered by the first conveyor so that particulate fuel in the bottom portion of each flight of the second auger does not come above the auger shaft and into direct contact with fuel between the next rearwardly adjacent auger flight to prevent backfire in the second auger tube.

Combustion air system 13 provides three vertically spaced annular plena on the outer surface of fire pot 30, with upper plenum 50 extending about the upper annular array of combustion air holes, medial plenum 51 extending about the medial array of such holes, and lower plenum 52 extending about the lower array of input air holes. Upper plenum 50 communicates with medial plenum 51 by plural ducts 53 extending vertically therebetween. As seen in FIG. 6, common upper air duct 54 communicates from upper plenum 50 to the adjustment valve structure 57. Lower air input duct 55 communicates from lower plenum 52 to the adjustment valve structure. Pilot air duct 56 communicates from the adjustment valve structure to the fire pot wall immediately adjacent the inner end portion of auger tube 44 to provide combustion air to sustain a pilot burn in the inner end portion of that tube.

The adjustment valve structure provides manually adjustable upper air valve 57*a*, lower air valve 57*b*, and pilot air valve 57*c* to regulate relative input of air into each of the ducts interconnected therewith from the common combustion air input duct 58 which inputs air from the ambient atmosphere through lower orifice 59. There is no positive pressure in the air input system as my stove operatives by reason of negative (below atmospheric) pressure created in the exhaust system.

A washing system for window 81 defined in front access door 25 is provided by washer duct 79 extending upwardly and forwardly from combustion air input duct 54 to a position in the fire chamber above and spacedly rearward the window. Duct 79 carries in its upper end portion elongate deflector 80 which deflects pre-heated incoming combustion air downwardly over the inner surface of the window 81 to tend to keep dirty combustion air away and keep it cleaner, especially from the condensation or accumulation of combustion products thereon. This type of window washing in stoves is not novel per se and heretofore has been used in stoves for the same purpose.

Exhaust system 14 provides heat exchange chamber 60 defined between back 19 of the stove casement and forward portion of hopper 37 by the rearward extensions of casement bottom 20 and sides 17*a*, 18*a* with fillet 62 carried in the upper portion of the chamber to define elongate upper output orifice 62. Air can also pass inwardly or outwardly from the sides of the heat exchange chamber through orifices 82. The lower portion of the heat exchange chamber communicates through fans 84 with the ambient atmosphere below casement bottom 20 to cause vertical motion of air upwardly through the heat exchange chamber and ultimately out through orifices 62 or 82.

Laterally extending lower exhaust plenum 64 carried in heat exchange chamber 60, on the outer surface of casement back 19 immediately upwardly adjacent the lower edge of that back element, communicates by plural orifices 65 defined in back 19 to the lower portion of fire chamber 22. A plurality of variously configured exhaust tubes 66 communicates from the lower exhaust plenum 64 upwardly through heat exchange chamber 60 to upper exhaust plenum 66 carried in the upper portion of the heat exchange chamber. This upper exhaust plenum in turn communicates with rearwardly extending exhaust pipe 67 which passes in somewhat horizontal orientation outwardly from the stove and through an exterior wall of a structure being heated to exit to the ambient atmosphere. The exhaust pipe carries suction fan 68 in its outer portion to create a negative gas pressure in the exhaust pipe to cause a flow of gas from the fire chamber, which in turn causes input air to flow therein from the input system by reason of the higher pressure of the ambient atmosphere. With this exhaust system a portion of the heat of exhaust gases is transferred to the air within heat exchange chamber 60 and as that air becomes heated, a circulation pattern is formed whereby that heated air rises by reason of its lower density to exit through output orifices 62 and 82 to cause more air to enter chamber 60 through input orifice 63 to establish a circulatory pattern.

Updraft orifice 68 is defined in the upper portion of back 19 of the casement to allow communication of the upper portion of the fire chamber with upper exhaust plenum 66. This updraft orifice is selectively shut by damper valve 69 which, in the instance shown, is supported by damper arm 70 carried by horizontal laterally extending axle 71 which is pivoted by solenoid 72 operating through linkage 83 for responsive opening and closing of the valve. The valve is normally biased by gravity to a closed condition. This updraft valve structure allows my stove to operate in an updraft mode by opening at critical burn periods to prevent smoking and other problems associated with downdraft operation at such times, and maintain safe stove operation.

The control system of my invention provides microprocessor 73 that controls the various operative systems of my stove responsive to temperature sensations of internal thermocouple 74 and external thermostat 75. The electronic control of these various operative systems has been heretofore known in the stove arts and is not novel per se. It is therefore not described in detail, other than to indicate its functional requisites as hereinafter set forth.

Having described the structure of my stove, its operation may be understood.

Firstly, a stove is created according to the foregoing specification and operatively installed in an area to be heated, with its exhaust appropriately positioned to remove combustion gases for disposal to the ambient atmosphere exteriorly of the structure to be serviced. The fuel hopper is filled with appropriate particulate bio-mass material, electric power is provided, and the system is activated by turning switch 76 on and manually starting a fire in the bottom portion of fire pot 30.

Upon activation, the system will institute its start-up burn cycle. In this cycle, damper valve 69 is closed, and exhaust fan 77 is activated to create a negative or less than atmospheric pressure in the output end of exhaust pipe 67. This creates a potential partial vacuum within fire chamber 22 and causes input of combustion air therein through the common combustion air input duct 58 by reason of the greater air pressure of the ambient atmosphere. This input combustion air is distributed through ducts 53, 54 to provide combustion air in the fire pot and in the pilot burn area at the inner end of second conveyor tube 44.

Simultaneously with the institution of the start-up cycle, the first and second fuel feed conveyors will be activated. Particulate bio-fuel passes by gravity into the first slower fuel conveyor and is moved rearwardly by auger 42 of that conveyor to a rearward position in auger tube 41 from whence it passes downwardly through exit orifice 43 into the rearward portion of the second faster fuel feed conveyor. Auger 45 of that second conveyor feeds this fuel forwardly in tube 44 toward fire pot 30. In so doing it is to be noted that, since the second conveyor operates at a speed twice that of the first conveyor and both conveyors are of similar nature, the second conveyor will never be full of particulate fuel. What fuel is carried by the second conveyor will be supported in the bottom portion of the auger tube by reason of gravity and the mass of fuel between each auger flight will be separated by the auger and will not form a continuous pathway through the fuel to allow burnback. The fuel ultimately passes through the second input conveyor into pilot burn area 78 and thence into the chamber defined by fire pot 30. As this occurs, the bio-fuel will ignite in the fire pot by reason of the then existing fire and will burn back into the pilot burner area 78 in the end part of auger tube 44 to ignite fuel there present. The rotation of the second conveyor auger will rotate agitator 47 eccentrically in the fire pot to admix the burning fuel therein.

As this start-up cycle continues, the agitation and mixing of the bio-fuel mass in the lower portion of fire pot 30 will tend to make the combustion of that material more uniform and homogeneous throughout its mass. It also will tend to cause fly ash to move upwardly and outwardly of the combustion container so that the ash will come to rest on the floor of the fire chamber for removal. The agitation will also tend to break up and prevent formation of clinker material and will break up and stop the formation of a hard upper surface crust which tends to form in the burning process of cereal grains to make that process less efficient and even sometimes tends to stop combustion. The pellet material in pilot burn area 78 will tend to be pre-ignited and sustain combustion by reason of the combustion air input into that area through duct 55, so that much or all of such material will be preignited by the time it enters the fire pot 30.

The start up cycle will continue for a predetermined period of time, notwithstanding that the temperature sensed by internal thermal couple 74 is below the normal shut-down temperature. When the internal thermocouple senses adequate temperature at the end of start up cycle time period, the stove will continue to run at a high burn cycle if required by external thermostat demand or else will go into a slow burn cycle.

In the high burn cycle, the fuel input conveyors will continue to input fuel at a high burn rate and the exhaust fan will continue operation. The heated combustion gases generated in the fire pot in the high burn cycle will move upwardly therefrom by reason of their lower density resulting from their higher temperature. As the combustion gases rise to the undersurface of top 21, they necessarily can rise no further by reason of this physical barrier and therefore will be diverted laterally and ultimately downwardly. This will create a potentially higher pressure in the upper part of the fire chamber and at the same time there will be a somewhat lower pressure area at and about the orifices 65 of the lower exhaust plenum 64 caused by operation of exhaust fan 77 in the outer end portion of exhaust pipe 67. This pressure difference will establish an air flow pattern wherein input air enters the combustion chamber where it is heated so that it moves upwardly to the upper portion of the fire chamber and thence downwardly to the lower rearward portion of the fire chamber where it is exhausted through lower exhaust plenum 64 to continue downdraft operation.

This general downdraft type circulation of combustion gases will cause a part of such gases to pass downwardly around the outer periphery of fire pot 30. As this occurs, some of those combustion gases will reenter the fire pot through combustion gas holes 35 and as this occurs, any incompletely burned gases therein will tend to be more completely oxidized as they pass upwardly through the upper portion of the combustion container and the active combustion zone thereabove. This circulatory pattern will be somewhat enhanced by the upwardly moving gases in the combustion container, which by reason of gaseous friction, slightly lowered pressure, or both, will tend to encourage the entry of combustion gases in the fire chamber through combustion gas holes 35 and into the fire pot. The circulatory pattern will be enhanced by air from the window washer passing downwardly in the forward part of the fire chamber and by the rearwardly positioned down draft exhaust.

The high-fire combustion cycle will continue until a predetermined ambient temperature is sensed by external thermostat 75, physically positioned in an area to be heated, at which point the full burn cycle will be stopped and a low burn cycle instituted.

Upon institution of the low burn cycle, the exhaust fan and fuel conveyor system will continue operation, but the speed of both fuel conveyors will be simultaneously reduced in speed so that the second conveyor feeds fuel at a low burn rate of approximately 1/10th pound per hour into the pilot burn area. This rate of fuel feed will be sufficient to maintain a pilot burn, but in general will pass little if any fuel into fire pot 30. The fuel in the pilot burn area will have been ignited during the high-fire cycle and will be combusting at the institution of the low burn cycle. This combustion of fuel in pilot burn area 78 will be maintained by reason of the additional fuel fed therein through the conveyor system and by combustion air input through duct 56, which will continue through the low burn cycle. After institution of the low burn cycle, combustion air will be continued through the three container plena for a period of time to allow consumption of the fuel in the combustion container. When that has been accomplished, as measured by attainment of a predetermined temperature sensed by thermocouple 74 in the combustion container, the combustion air input to the combustion pot plena will be terminated until institution of the next cycle.

As a matter of safety of operation, updraft orifice 68 is opened by damper 69 to allow updraft operation upon power failure or cessation of operation of any of the operating systems of my stove, as sensed by its microprocessor control system. This provides a substantially fail-safe operation of the stove. So long as the stove is in operative condition, exhaust fan 77 and first and second fuel feed conveyors will remain continuously operative to always maintain a pilot fire and a forced draft for that pilot fire.

The foregoing description of my invention is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by Letters Patent and

What I claim is:

1. A stove for burning particulate bio-fuel that maintains a pilot burn and operates selectively in updraft and downdraft modes comprising, in combination:

a casement, peripherally defining an enclosed fire chamber, and having at lease one latchable, hingeably openable access door;

a fire pot carried in the lower medial portion of the fire chamber, said fire pot having an open top and defining a plurality of combustion air input holes defined in vertically spaced annular arrays in the upper portion, the medial portion and the lower portion of the fire pot, and a plurality of spaced annularly arrayed combustion gas holes defined in the fire pot between the upper and medial annular arrays of combustion air holes;

a fuel feed system having a hopper spacedly adjacent the casement for gravity feed of particulate fuel through a lower orifice to a conveyor system having a first conveyor to receive fuel from the hopper and deliver the fuel to a second auger conveyor that moves the fuel approximately twice as fast as the first conveyor, said second auger conveyor having a cylindrical tube carrying a rotatable auger communicating through an orifice defined in the fire pot immediately above its bottom to define a pilot burn area in the end of the cylindrical tube adjacent the fire pot;

means of supplying combustion air to the combustion air holes defined in the fire pot;

means of exhausting combustion gases from the fire chamber, and means of operating the fuel supply conveyors.

2. The invention of claim 1 wherein the means of supplying combustion air to the combustion air input holes comprise:

three vertical spaced annular plena carried by the exterior surface of the fire pot, one plenum communicating with the upper combustion air input holes, one plenum communicating with the medial combustion air input holes and one plenum communicating with the lower combustion air input holes, each said plena communicating through ducting and valving means to a common combustion air input duct to receive combustion air from the ambient atmosphere externally of the fire chamber defined by the casement.

3. The invention of claim 1 wherein the means of exhausting combustion gases from the fire chamber comprise:

an elongate, laterally extending lower exhaust plenum carried on the external surface of the lower portion of the casement and communicating through the casement to the fire chamber by plural orifices in the lower portion of the casement;

an upper exhaust plenum carried on the external surface of the upper portion of the casement and communicating through the casement to the upper portion of the fire chamber through an updraft orifice defined in the upper portion of the casement, said updraft orifice having a valve for selective opening and closing; and said lower exhaust plenum communicating with said upper exhaust plenum which communicates with an exhaust channel having an associated exhaust fan to create negative pressure in said exhaust channel to aid transit of combustion gases through the exhaust channel.

4. The invention of claim 3 further characterized by:

a heat exchange chamber containing the upper and lower exhaust plenum and having a lower input orifice and an upper output orifice, each said orifices communicating with the ambient atmosphere, and a plurality of spacedly related ducts communicating from the lower exhaust plenum to the upper exhaust plenum and carried in the heat exchange chamber to provide means for transfer of heat from the said ducts to air within the heat exchange chamber.

5. The invention of claim 3 further characterized by the upper exhaust valve being opened by thermostatically controlled valve means responsive to temperature within the combustion container being below a predetermined value to cause updraft operation of the stove, but said upper exhaust valve being closed at all other times to cause downdraft operation of the stove.

6. The invention of claim 1 further characterized by the auger of the second conveyor having a medial axially aligned shaft, the end portion of said shaft adjacent the fire pot carrying eccentric agitator means to rotate with said auger shaft to cause the agitator to move and admix fuel in the lower portion of the fire chamber.

7. The invention of claim 1 having control means including an internal thermocouple and external thermostat, the external thermostat positioned to sense the temperature of the ambient atmosphere in an area to be heated by the stove and cause institution of a burn cycle when the temperature sensed falls below a predetermined value, and an internal thermocouple sensing temperature in the combustion container to cause opening of the upper exhaust damper when the temperature sensed in the fire pot is below a predetermined value.

8. A stove, for burning solid particulate bio-fuel, that maintains a continuous pilot burn and operates selectively in updraft and downdraft exhaust modes, comprising in combination:

a casement peripherally defining an enclosed fire chamber and at least one latchable, hingeably openable access door with a transparent window in the medial portion of the access door;

a combustion container carried in the lower medial portion of the fire chamber, said combustion container having a fire pot defining three annular vertically spaced arrays of combustion air holes, an annular array of combustion gas holes between upper and medial arrays of combustion air holes, and a fuel conveyor orifice in the lower portion thereof;

a fuel supply system having a hopper spacedly adjacent the casement with a lower orifice feeding fuel to a first slower conveyor that moves the fuel to a second faster auger conveyor, said second auger conveyor having a cylindrical tube rotatably carrying an auger communicating with the fuel conveyor orifice defined in the fire pot to define a pilot burn area adjacent the fire pot, said second conveyor auger being carried by a shaft carrying an agitator extending into the fire pot to move and admix material in the lower portion of the fire pot;

a combustion air system having a pilot fire duct to supply combustion air to the pilot burn area defined in the second conveyor tube and three vertically spaced plena on the exterior of the fire pot adjacent each of the annular arrays of air input holes, each said plenum and the pilot fire duct communicating through ducting and valving means to a common combustion air input duct to receive combustion air from the ambient atmosphere externally of the casement;

an exhaust system having an elongate laterally extending lower exhaust plenum carried on the lower external portion of the casement and communicating with the fire chamber by plural orifices defined in the lower portion of the casement, and an upper exhaust plenum carried on the external surface of the upper portion of the casement vertically above the lower exhaust plenum and communicating to the fire chamber through an updraft orifice defined in the upper portion of the casement, said updraft orifice having a normally closed valve for selective opening, and said lower exhaust plenum communicating with said upper exhaust plenum which communicates with an exhaust channel having an exhaust fan to create a pressure below atmospheric pressure in the exhaust channel to aid exhaustation of combustion gases; and a control system having a micro-processor and an internal thermocouple and external thermostat, said external thermostat positioned in an area to be heated to institute a full burn cycle responsive to sensed temperature below a predetermined value, and said internal thermocouple carried by the combustion container to open the updraft valve responsive to sensed temperature in the combustion container below a predetermined value.

9. The invention of claim 8 further characterized by:

a window cleaning system having a duct communicating from the common combustion air input duct upwardly and forwardly to a position in the fire chamber above and immediately inwardly of the window defined in the access door, said duct carrying a deflector in its end portion to direct air flowing through the duct downwardly across the access door window.

10. The invention of claim 8 further characterized by the control system having startup, high burn and low burn cycles;

said startup cycle being instituted when the stove is turned on and continuing for a predetermined time to cause fuel to be fed from the hopper through the first and second conveyors and into the fire pot, the updraft valve to remain closed, and the exhaust fan to operate;

said high burn cycle being instituted responsive to temperature sensed by the external thermostat below a predetermined value and temperature sensed by the internal thermocouple above a predetermined value to cause the updraft valve to close, continued operation of the exhaust fan, operation of air circulation fans, and full burn operation of the fuel conveyors; and said low burn cycle being instituted responsive to the external thermostat sensing temperature above a predetermined value to cause lowering of the speed of first and second conveyors and reduced speed of the exhaust fan.

11. The invention of claim 8 further characterized by a heat exchange chamber defined between the casement and the fuel hopper, with a lower input orifice and an upper output orifice and the lower exhaust plenum communicating to the upper exhaust plenum by a plurality of ducts contained within said heat chamber to heat air rising through the heat exchange chamber.

* * * * *